US011454159B2

(12) United States Patent
Quix et al.

(10) Patent No.: US 11,454,159 B2
(45) Date of Patent: Sep. 27, 2022

(54) METHODS AND SYSTEM FOR A COOLANT CIRCUIT VALVE

(71) Applicant: Ford Global Technologies, LLC, Dearborn, MI (US)

(72) Inventors: Hans Guenter Quix, Herzogenrath (DE); David van Bebber, Aachen (DE); Jan Mehring, Cologne (DE); Antonio Farina, Übach-Palenberg (DE); Herbert Ernst, Kerkrade (NL)

(73) Assignee: Ford Global Technologies, LLC, Dearborn, MI (US)

( * ) Notice: Subject to any disclaimer, the term of this patent is extended or adjusted under 35 U.S.C. 154(b) by 351 days.

(21) Appl. No.: 16/673,700

(22) Filed: Nov. 4, 2019

(65) Prior Publication Data

US 2020/0158003 A1 May 21, 2020

(30) Foreign Application Priority Data

Nov. 21, 2018 (DE) ..... 102018219949.3

(51) Int. Cl.

| | |
|---|---|
| ***F01P 7/14*** | (2006.01) |
| ***F01P 7/16*** | (2006.01) |
| ***F02B 29/04*** | (2006.01) |
| ***F01P 3/18*** | (2006.01) |
| ***F01P 5/10*** | (2006.01) |

(52) U.S. Cl.

CPC *F01P 7/16* (2013.01); *F01P 3/18* (2013.01); *F01P 5/10* (2013.01); *F02B 29/0425* (2013.01); *F02B 29/0456* (2013.01); *F01P 2003/182* (2013.01); *F01P 2007/146* (2013.01); *F01P 2025/04* (2013.01); *F01P 2025/42* (2013.01)

(58) Field of Classification Search

CPC ..... F01P 7/16; F01P 3/18; F01P 5/10; F01P 2003/182; F01P 2007/146; F01P 2025/04; F01P 2025/42; F02B 29/0425; F02B 29/0456

USPC ..... 123/41.1

See application file for complete search history.

(56) References Cited

U.S. PATENT DOCUMENTS 4,545,333 A * 10/1985 Nagumo ..... F01P 7/167 123/41.02
5,020,482 A * 6/1991 Deutschmann ..... F01P 3/20 123/41.29
5,174,254 A * 12/1992 Humburg ..... B60H 1/00485 123/142.5 R
5,404,842 A * 4/1995 Matsushiro ..... F01P 7/167 123/41.1
5,494,005 A * 2/1996 Saur ..... G05D 23/134 123/41.1

(Continued)

FOREIGN PATENT DOCUMENTS

CN 103615302 A 3/2014
DE 3433319 A1 3/1986

(Continued)

*Primary Examiner* — Hung Q Nguyen
*Assistant Examiner* — Anthony Donald Taylor, Jr.
(74) *Attorney, Agent, or Firm* — Vincent Mastrogiacomo; McCoy Russell LLP

(57) ABSTRACT

Methods and systems are provided for a coolant circuit. In one example, the coolant circuit comprises high and low-temperature radiators, where only one pump is configured to conduct coolant through the entire coolant circuit.

19 Claims, 10 Drawing Sheets

(56) References Cited

U.S. PATENT DOCUMENTS

| | | | | |
|---|---|---|---|---|
| 5,727,729 | A * | 3/1998 | Hutchins | F01P 7/16 123/41.1 |
| 5,979,778 | A * | 11/1999 | Saur | F01P 7/16 236/34.5 |
| 6,065,682 | A * | 5/2000 | Frunzetti | F01P 7/16 236/12.15 |
| 7,128,025 | B1 | 10/2006 | Westhoff, Jr. et al. | |
| 8,424,303 | B2 * | 4/2013 | Kardos | F02B 29/0443 60/599 |
| 8,991,719 | B2 * | 3/2015 | Sheppard | F01M 5/007 236/34.5 |
| 9,709,065 | B2 | 7/2017 | Mehravaran et al. | |
| 2003/0221638 | A1 * | 12/2003 | Haase | F01P 7/165 123/41.01 |
| 2004/0163612 | A1 * | 8/2004 | Takahashi | G05D 23/1333 123/41.1 |
| 2004/0216700 | A1 * | 11/2004 | Hutchins | B60H 1/00314 123/41.08 |
| 2006/0117748 | A1 * | 6/2006 | Bundschuh | F02B 29/0493 60/599 |
| 2012/0018127 | A1 | 1/2012 | Iwasaki | |
| 2014/0374498 | A1 * | 12/2014 | Quix | B60H 1/02 237/12.3 R |
| 2019/0271995 | A1 * | 9/2019 | Arbel | G05D 23/1333 |

FOREIGN PATENT DOCUMENTS

| | | | |
|---|---|---|---|
| DE | 3824412 | C1 | 8/1989 |
| DE | 10317003 | A1 | 12/2004 |
| DE | 602004004250 | T2 | 11/2007 |
| DE | 102015113061 | A1 | 4/2016 |
| KR | 20020045822 | A | 6/2002 |

* cited by examiner

METHODS AND SYSTEM FOR A COOLANT CIRCUIT VALVE

CROSS REFERENCE TO RELATED APPLICATIONS

The present application claims priority to German patent application No. 102018219949.3, filed on Nov. 21, 2018. The entire contents of the above-listed application is hereby incorporated by reference for all purposes.

FIELD

The present description relates generally to a control valve for controlling a coolant circuit for a charge-air cooler.

BACKGROUND/SUMMARY

Internal combustion engine systems may be equipped with a turbocharger in order to increase the efficiency of the internal combustion engine. To further increase efficiency, the charge air compressed by a compressor of the turbocharger may be cooled, because charge air warmed as a result of the compression demands a larger volume and thus has a lower density than cooled air. In this context, charge-air cooling systems are known which cool the charge air without an additional cooling system directly at the vehicle front end, for example via an air/air heat exchanger. Alternatively or in addition, the charge-air coolers may be connected to a coolant circuit. The coolant circuit will also be referred to as low-temperature coolant circuit relative to a high-temperature coolant circuit, which cools the engine and other hotter components.

The low-temperature coolant circuit may be configured as a separate cooling system and is not connected to the high-temperature coolant circuit. The two circuits may be equipped with individual heat exchangers and separate water pumps. In some cases, a common expansion tank is used. The individual coolant pumps may be controlled separately in order to attain the desired functionality under different operating conditions. Examples of corresponding coolant circuits are disclosed in the documents US 2012/0018127 A1 and U.S. Pat. No. 9,709,065 B2.

It is an object of the present disclosure to further improve the described coolant circuits, in particular with regard to disadvantages that arise from the separation of the low-temperature coolant circuit and the high-temperature coolant circuit, for example with regard to costs, weight and stowage space.

The issues described above may be at least partially solved by a control valve according to the disclosure, wherein the control valve is configured for controlling the flow of a first fluid medium. Said control valve comprises a housing which comprises a flow channel for the fluid medium with an inlet and an outlet. The control valve furthermore comprises a closure for at least partially opening and closing the flow channel. The control valve furthermore comprises an access for at least one second fluid medium, wherein the closure is designed to be moved in the flow channel for the first fluid medium by the pressure of the second fluid medium, and a thermostat with a connection in terms of flow to the flow channel for the first fluid medium. The thermostat is arranged between the closure and the outlet. The control valve comprises a first spring, which is arranged between the closure and the thermostat. The control valve furthermore comprises a second spring, which is arranged between the thermostat and the outlet and which holds the first spring in a stop position. The closure can be moved counter to the pressure of the first spring by the pressure of the second fluid medium. The thermostat is configured to control the opening characteristic curve of the closure, such that the closure closes the flow channel of the first fluid medium in a first working state and at least partially opens said flow channel in a second working state. Here, the second spring can be pushed together or compressed, wherein the position of the stop and, here, the preload of the first spring can be controlled.

The control valve according to the disclosure has the advantage that it is controlled simultaneously by the pressure of the first fluid medium, by the pressure of the second fluid medium, and by the temperature of the first fluid medium, in one example. The first fluid medium may be a coolant of a high-temperature coolant circuit for a charge-air cooler for an internal combustion engine of a vehicle. The access for the second fluid medium advantageously has a connection in terms of flow to an intake tract of an internal combustion engine. This has the advantage that the control valve can be controlled via the charge pressure.

In a further variant, the control valve is configured to detect the temperature of the first fluid medium via the thermostat. Here, the closure may be configured such that, in the first working state, that is to say in the closed state, the inlet is connected in terms of flow to the thermostat, such that a fraction of the first fluid medium can flow to the thermostat. This may be realized for example by virtue of a leakage flow opening being provided. Alternatively, a bypass flow channel may be provided, as illustrated by dashed line 69. In one example, the dashed line 69 illustrates a bleed line 69 fluidly coupling the control valve inlet to the thermostat. The possibility of detecting the temperature of the first fluid medium via the thermostat has the advantage that the control valve can be controlled in a manner dependent on the temperature of the first fluid medium, that is to say for example of the coolant.

The cooling radiator arrangement according to the disclosure comprises an inlet and an outlet, a high-temperature cooling radiator arranged downstream of the inlet, a low-temperature cooling radiator arranged downstream of the high-temperature cooling radiator, and an outlet arranged downstream of the low-temperature cooling radiator. Furthermore, the high-temperature cooling radiator comprises an outlet, and the low-temperature cooling radiator comprises an inlet. The outlet of the high-temperature cooling radiator is connected in terms of flow to the inlet of the low-temperature cooling radiator via a flow channel. Here, a control valve according to the disclosure is arranged in the flow channel.

Thus, in other words, in the cooling radiator arrangement according to the disclosure, the outlet of the high-temperature cooling radiator is connected directly to the inlet of the low-temperature cooling radiator. The low-temperature cooling circuit is thus also connected to the high-temperature cooling circuit, and a common coolant pump, for example water pump, can be used for the cooling circuit. Costs, weight, and stowage space are saved in this way.

In one variant, the low-temperature cooling radiator is integrated into the high-temperature cooling radiator, for example in the form of a low-temperature cooling radiator element. In this way, a compact arrangement is realized.

Via the control valve according to the disclosure, the coolant flow in the low-temperature coolant circuit can be automatically controlled, in particular in a manner dependent on the charge pressure, on the temperature of the coolant and on the pressure of the coolant. Typically, more intense cooling of the charge air is desired in the case of higher engine loads and operating states with high engine speeds. This is executed via the control of the valve in a manner dependent on the charge pressure. Via the simultaneous control of the valve in a manner dependent on the temperature of the coolant via the thermostat, the throughflow rate to the low-temperature cooling radiator is automatically controlled in a manner dependent on the coolant temperature. Altogether, therefore, no additional coolant pump is desired for the low-temperature coolant circuit. At the same time, simple and robust control of the low-temperature circuit for the charge-air cooling is provided via the control valve. Furthermore, the complexity of the cooling system, and thus also the susceptibility thereof to failure, is reduced.

The arrangement according to the disclosure of an internal combustion engine with a charge-air cooler in an intake tract, which charge-air cooler is connected to a coolant circuit, wherein the coolant circuit comprises a high-temperature coolant circuit and a low-temperature coolant circuit, relates to an internal combustion engine which is connected to the high-temperature coolant circuit. The intake tract is connected to the low-temperature coolant circuit. The arrangement according to the disclosure comprises a cooling radiator arrangement, wherein the high-temperature coolant circuit is connected to the inlet of the cooling radiator arrangement, and the low-temperature medium circuit is connected to the outlet of the cooling radiator arrangement. The arrangement according to the disclosure has the features and advantages already mentioned above.

The method according to the disclosure for operating an above-described arrangement according to the disclosure comprises the following steps including an internal combustion engine is operated, wherein the control valve is closed, and the temperature of the coolant is detected via the thermostat. The closure is at least partially opened via the pressure of the intake air if a certain threshold value of the pressure of the intake air is overshot. In addition or alternatively, the closure is at least partially opened by the pressure of the coolant if a certain threshold value of the pressure of the coolant is overshot. In addition or alternatively, the opening characteristic curve of the closure is varied via the action of the thermostat if a particular threshold value of the temperature of the coolant is overshot. The method according to the disclosure has the advantages already mentioned above. It permits in particular flexible control of the coolant circuit in a manner adapted to a situation.

The motor vehicle according to the disclosure comprises an above-described arrangement according to the disclosure of an internal combustion engine having a charge-air cooler in an intake tract, which charge-air cooler is connected to a coolant circuit. The motor vehicle according to the disclosure may be a passenger motor vehicle, a heavy goods vehicle, a bus, a minibus or a motorcycle. The motor vehicle according to the disclosure has the features and advantages already mentioned above.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
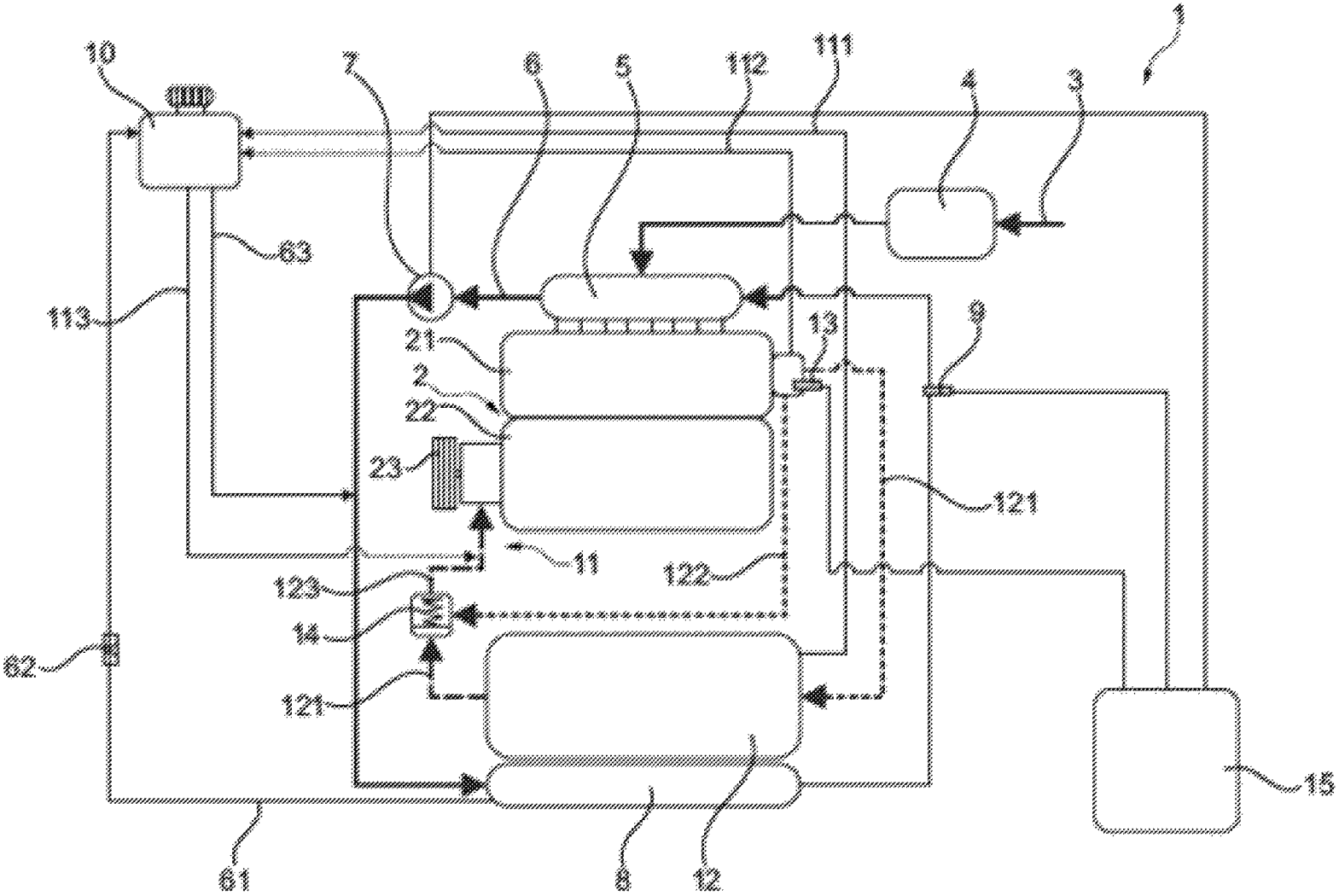
FIG. 1 (Prior Art)
FIG. 1 schematically shows arrangement of a charge-air cooler cooling system according to the prior art.
Figure 2:
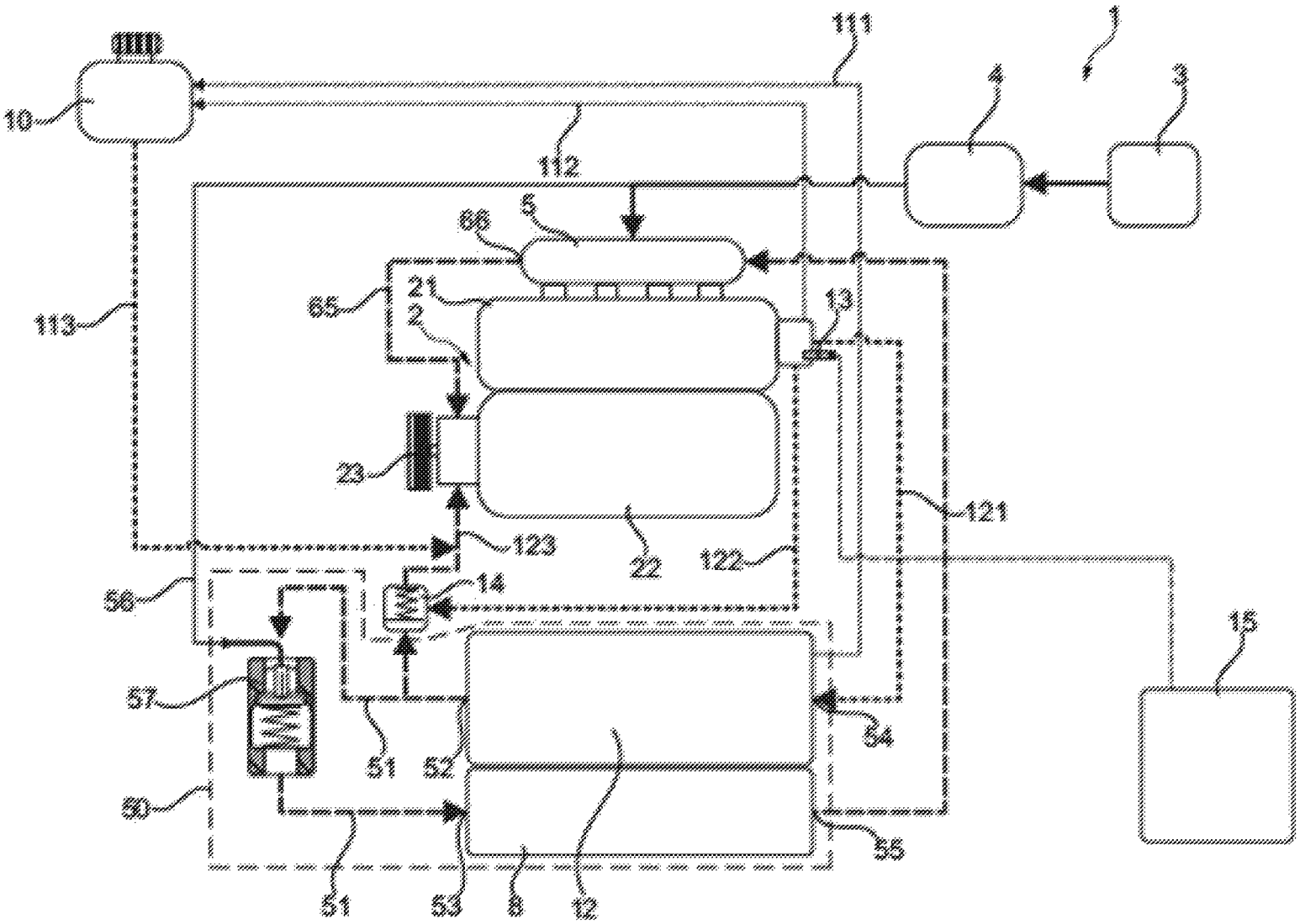
FIG. 2 schematically shows a first variant of an arrangement according to the disclosure of an internal combustion engine having a cooling radiator arrangement according to the disclosure.
Figure 3:
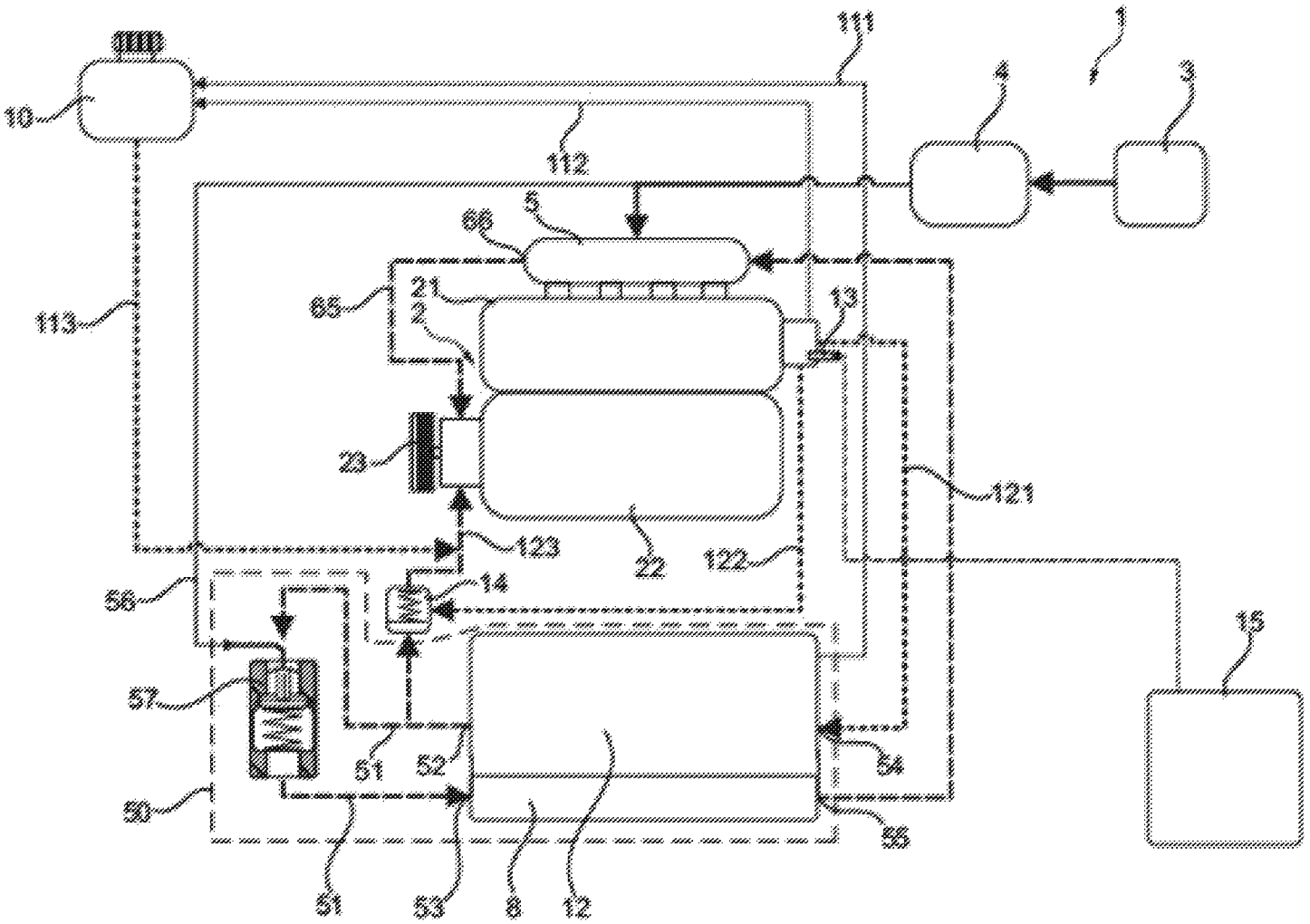
FIG. 3 schematically shows a second variant of an arrangement according to the disclosure of an internal combustion engine having a cooling radiator arrangement according to the disclosure.

The following description relates to systems and methods for a cooling arrangement of a vehicle. FIG. 1 illustrates a previous example of a cooling arrangement, wherein a primary pump is configured to conduct coolant through a high-temperature cooling arrangement and a secondary pump is configured to conduct coolant through a low-temperature cooling arrangement. FIGS. 2 and 3 illustrate first and second embodiments, respectively, which illustrate a single cooling arrangement comprising a main pump configured to pump coolant through a high-temperature portion and a low-temperature portion of the single cooling arrangement, wherein the high-temperature portion comprises a first radiator and the low-temperature portion comprises a second radiator. The embodiments of FIGS. 2 and 3 do not comprise a second pump. The embodiment of FIG. 3 differs from the embodiment of FIG. 2 in that a low-temperature radiator is integrally formed with a high-temperature radiator. That is to say, the low-temperature radiator is arranged in a common housing with the high-temperature radiator in the embodiment of FIG. 3.

Figure 4:
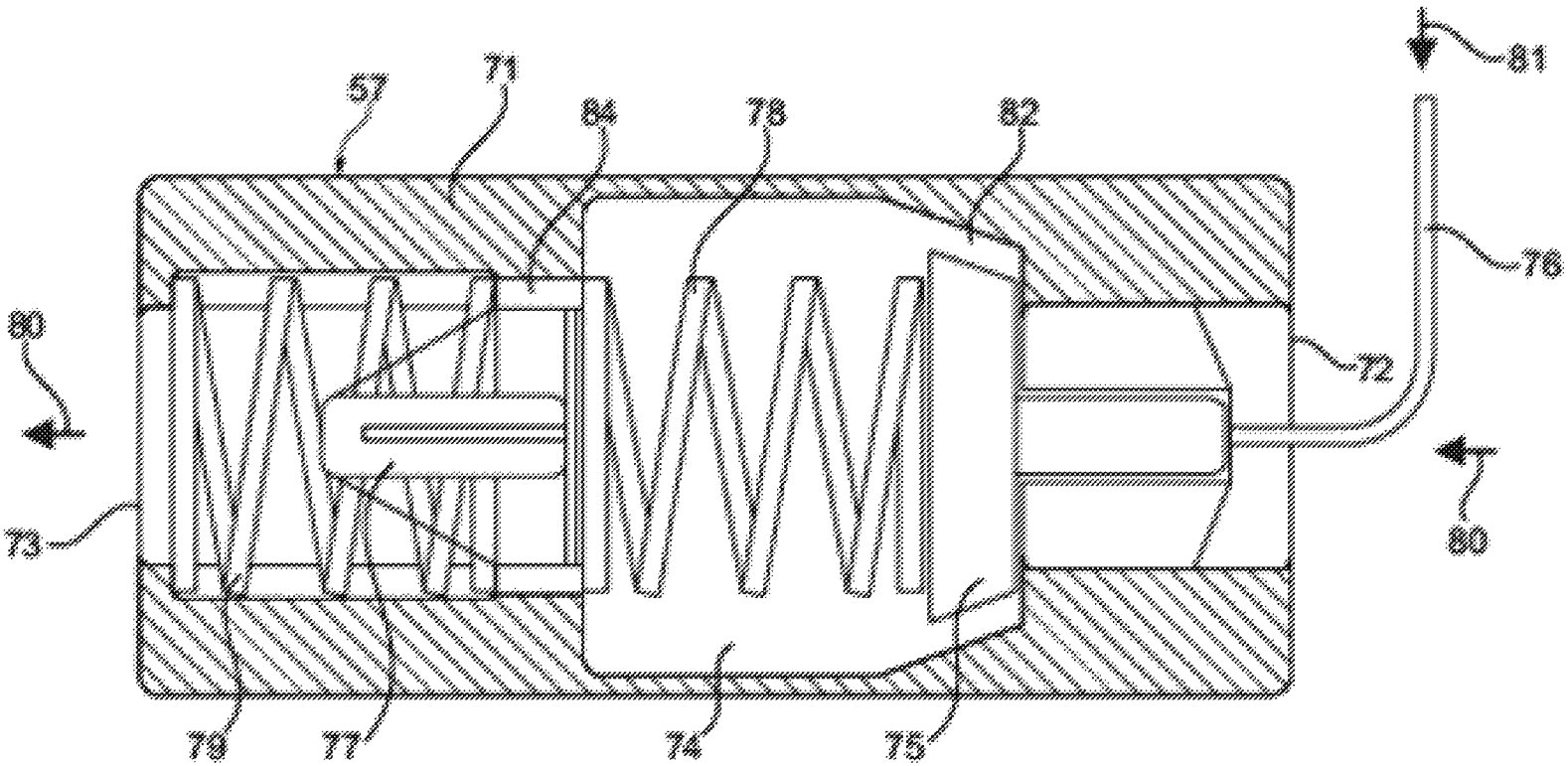
FIG. 4 schematically shows a control valve according to the disclosure in a sectional view in a first working state.
Figure 5:
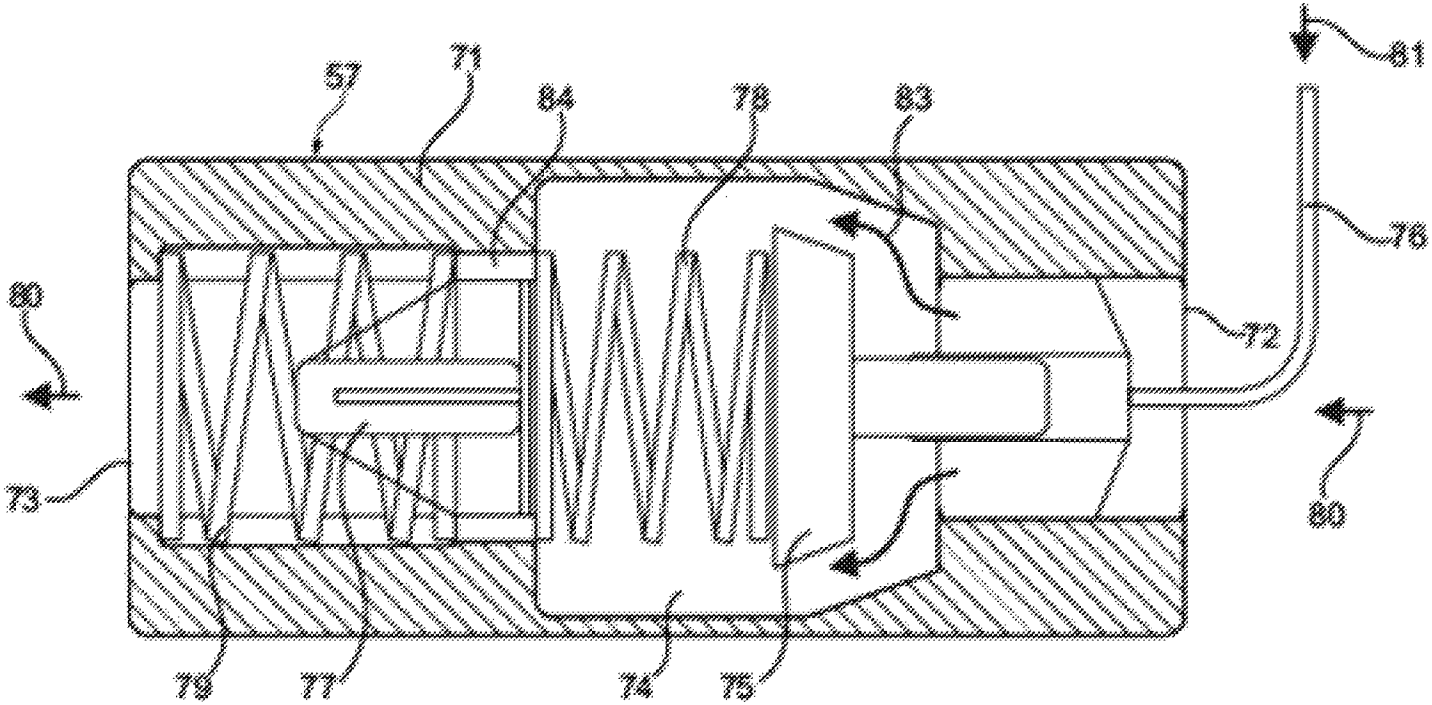
FIG. 5 schematically shows a control valve according to the disclosure in a sectional view in a second working state.
Figure 6:
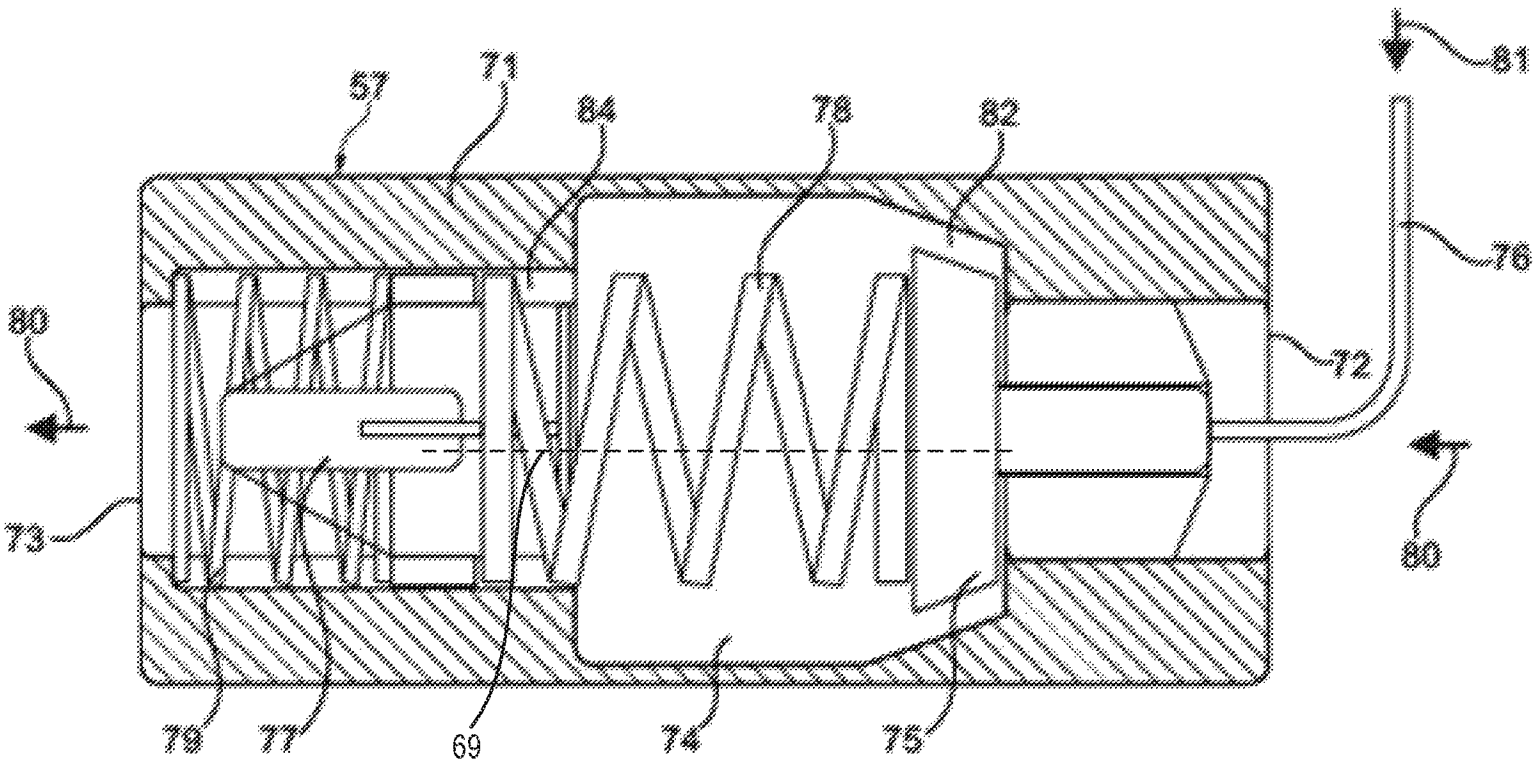
FIG. 6 schematically shows a control valve according to the disclosure in a sectional view in a first working state in a further variant.
Figure 7:
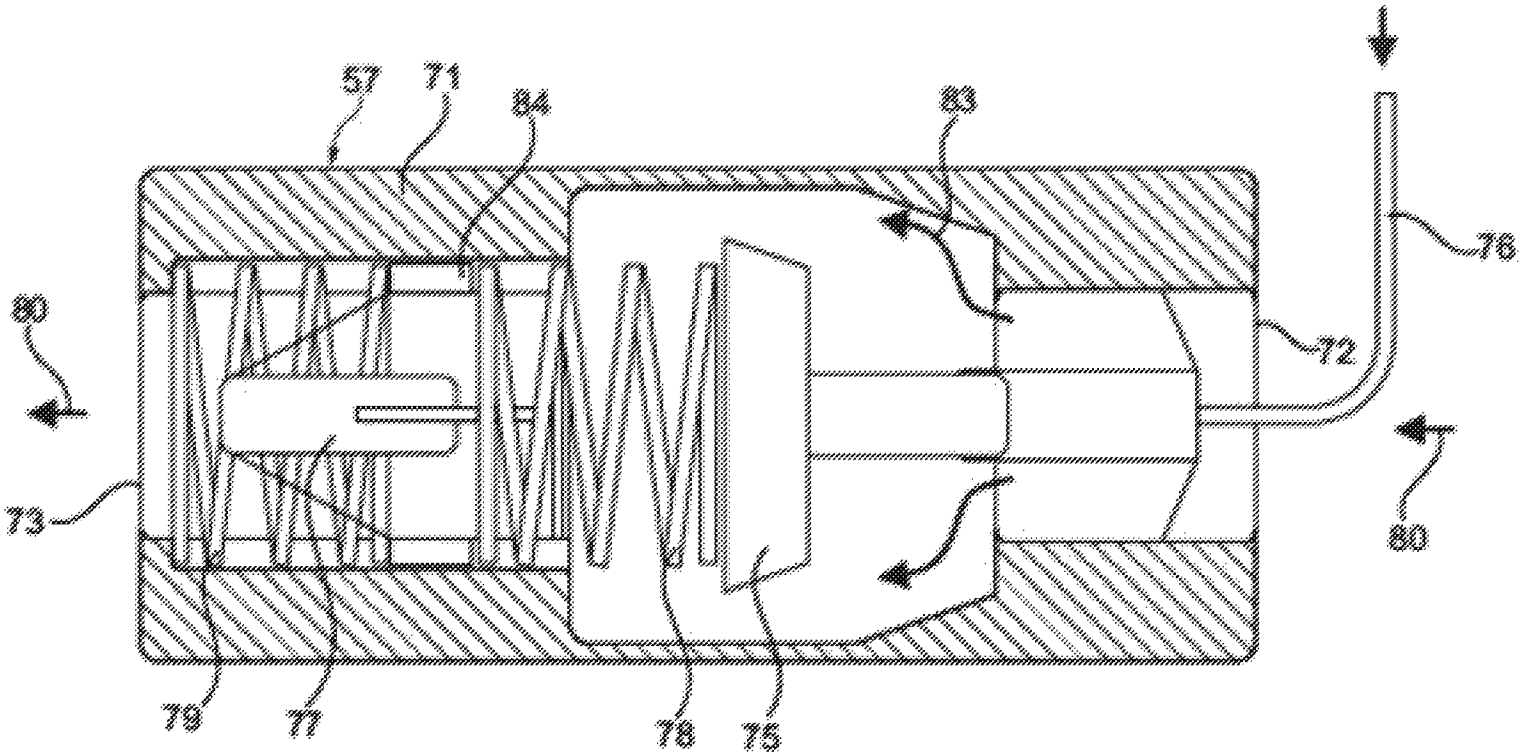
FIG. 7 schematically shows a control valve according to the disclosure in a sectional view in a second working state in a further variant.
Figure 8:
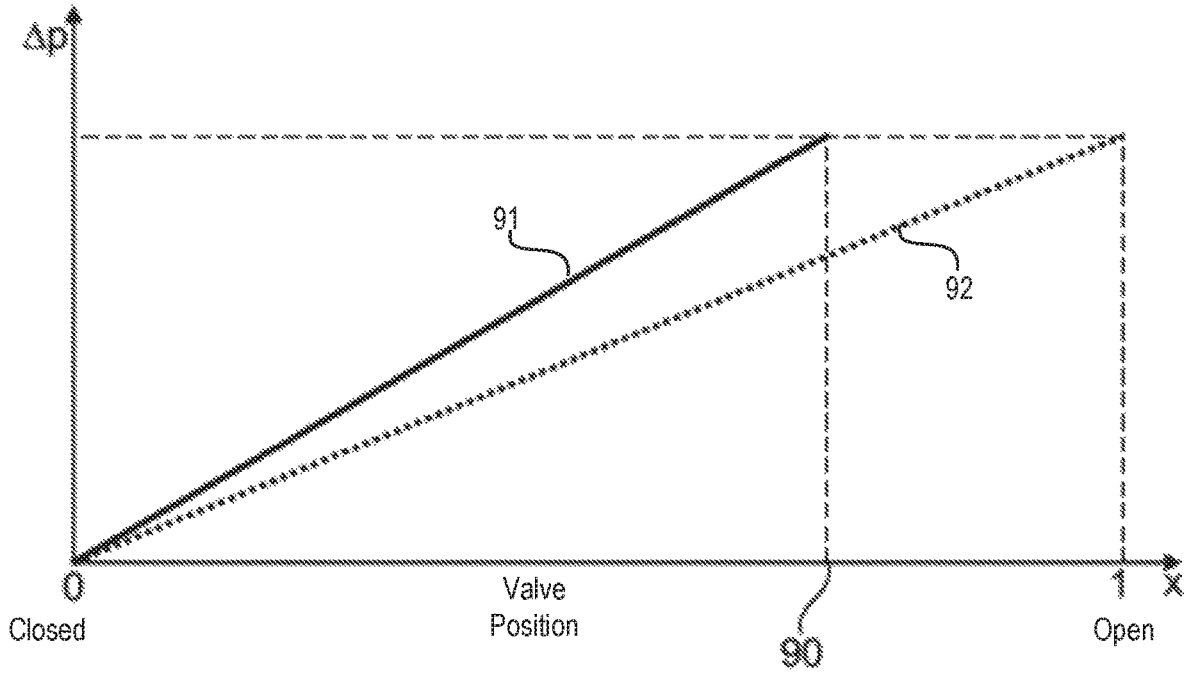
FIG. 8 schematically shows the valve setting or the working state of the control valve in a manner dependent on the pressure difference in the form of a diagram.
Figure 9:
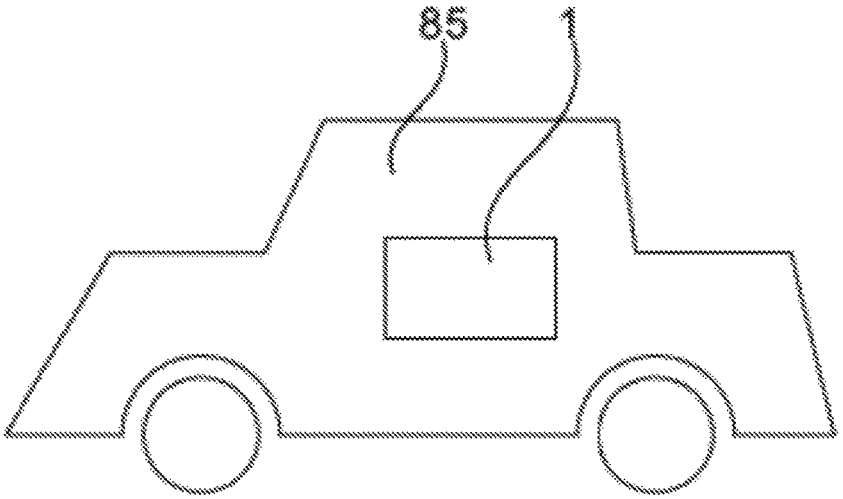
FIG. 9 schematically shows a motor vehicle according to the disclosure.
Figure 10:
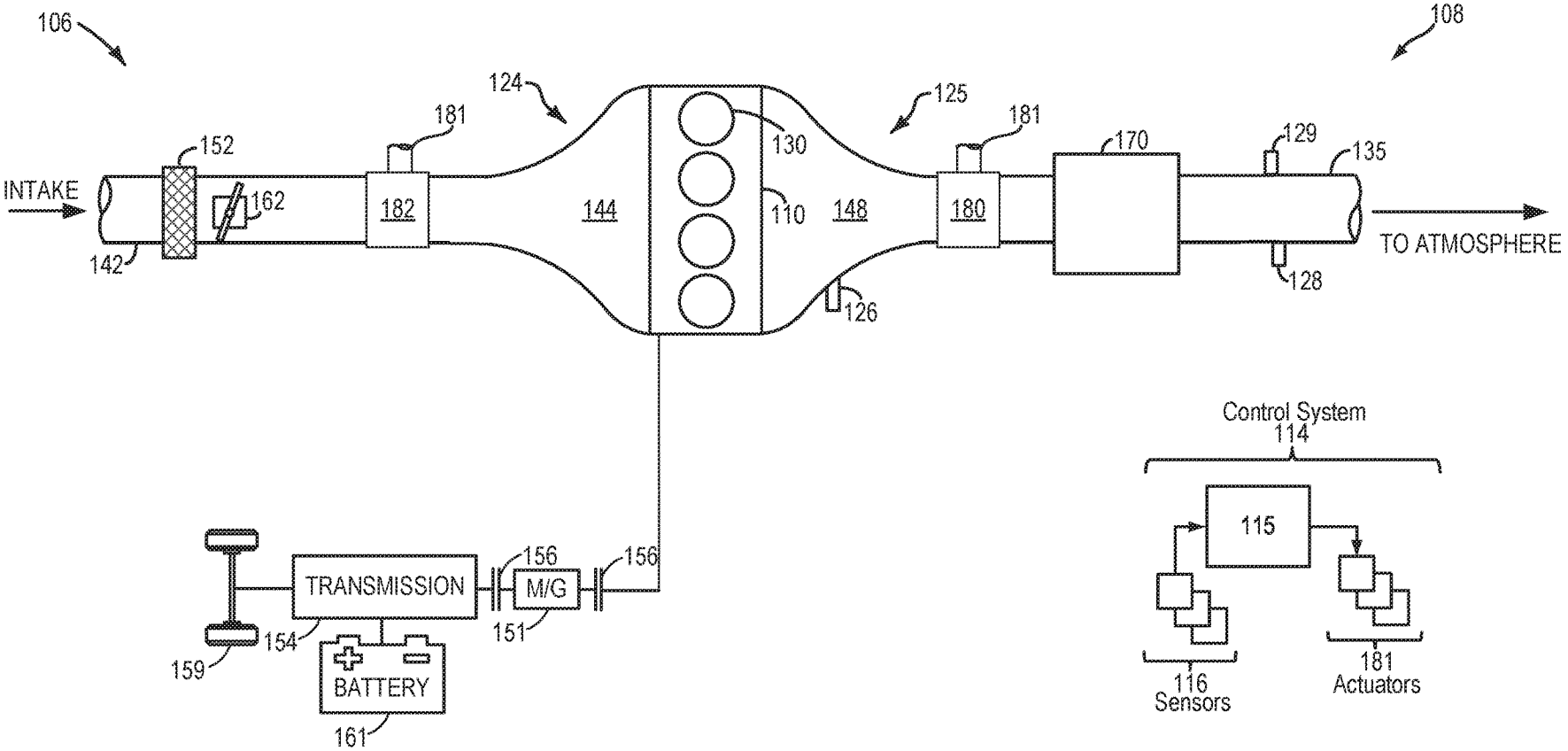
FIG. 10 shows an engine of a hybrid vehicle.
Figure 11:
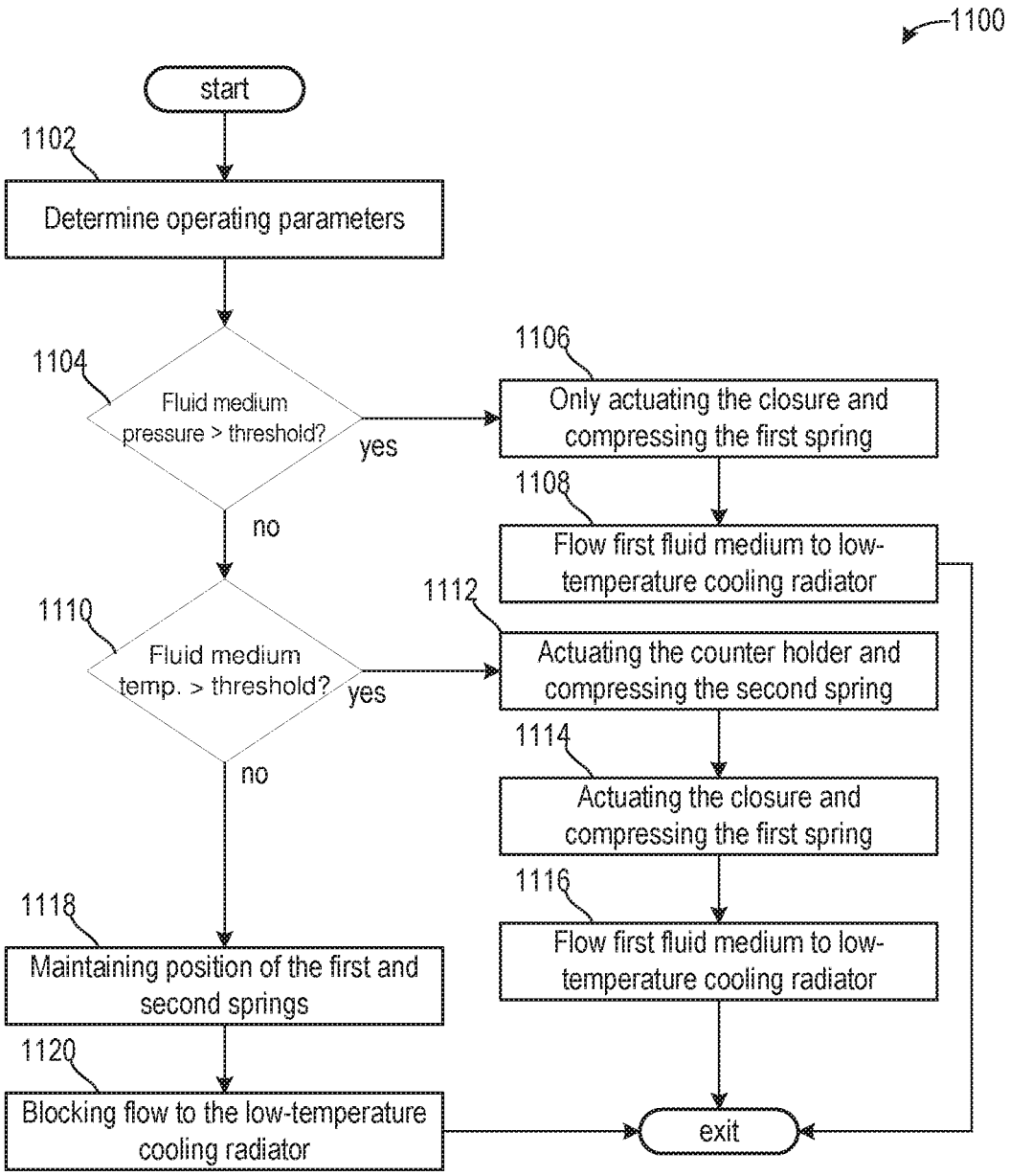
FIG. 11 shows a method for adjusting a position of the control valve.

A control valve is illustrated in FIGS. 4-7, wherein a schematic of a control valve is illustrated. The control valve is arranged between the high-temperature radiator and the low-temperature radiator. FIGS. 4 and 5 illustrate a first condition of the control valve wherein the valve is closed due to coolant and intake gas pressures being not greater than a threshold pressure in the embodiment of FIG. 4. The embodiment of FIG. 5 illustrates the control valve in a partially open position in response to one or more of a coolant pressure and an intake air pressure. As such, the control valve is configured to receive coolant from the high-temperature radiator and intake air from a portion of an intake passage downstream of a compressor. FIG. 6 also illustrates the control valve in a closed position due to a coolant temperature not being greater than a threshold temperature. FIG. 7 illustrates the control valve in an open position due to a coolant temperature being greater than the threshold temperature. FIG. 8 schematically shows the valve setting or the working state of the control valve in a manner dependent on the pressure difference in the form of a diagram. FIG. 9 schematically shows a motor vehicle according to the disclosure. FIG. 10 shows an engine of a hybrid vehicle. FIG. 11 shows a method for adjusting a position of the control valve.

FIG. 1 illustrates a conventional arrangement 1 of a previous example of an internal combustion engine 2 having an intake tract 3, which is provided for the feed of charge air to the internal combustion engine 2. In the intake tract 3, downstream of a compressor 4 which is part of a turbocharger, there is arranged a cooler 5 for cooling the charge air. The charge-air cooler 5 is connected to a first coolant circuit 6, which is also referred to as low-temperature coolant circuit 6. In the low-temperature coolant circuit 6, there are arranged an electric pump 7, a first cooling radiator 8 for cooling the coolant, and a first temperature sensor 9. For example, a water-glycol mixture is used as coolant. The low-temperature coolant circuit 6 is connected via a first expansion line 61, in which a throughflow limiter 62 is arranged, and a first feed line 63 to an expansion tank 10.

From the charge-air cooler 5, the charge air is conducted further to the cylinder head 21 of the internal combustion engine 2. The cylinder head 21 is connected to the cylinder 22. Situated in the cylinder 22 is the piston, the longitudinal movement of which, caused by the combustion of fuel, is converted into a rotational movement of a crankshaft.

The internal combustion engine is connected to a second coolant circuit 11, which is also referred to as high-temperature coolant circuit 11. The flow of the high-temperature coolant circuit 11 is effected by means of the main pump 23, which is driven by the crankshaft of the internal combustion engine 2. The pressure of the coolant of the high-temperature coolant circuit 11, for example of a water-glycol mixture, is thus in a functional relationship with the rotational speed of the internal combustion engine 2. The same coolant, for example, a water-glycol mixture, is used in the low-temperature coolant circuit 6 and high-temperature coolant circuit 11. A second cooling radiator 12 and a second temperature sensor 13 are arranged in the high-temperature coolant circuit 11. Here, the cooling liquid can, in a manner dependent on its temperature, be selectively conducted via a first sub-line 121 through the second cooling radiator 12 or via a second sub-line 122 past said second cooling radiator. For the control of the flow of the cooling liquid, a three-way valve 14 is used, at which the sub-lines 121, 122 merge to form a common line 123. The second coolant circuit 11 is likewise connected, via the second expansion line 111, third expansion line 112, and second feed line 113, to the expansion tank 10.

The first and second temperature sensors 9, 13 are connected to a control device 15. The control device is connected to the electric pump 7. In a manner dependent on the temperature of the respective cooling liquid in the low-temperature coolant circuit 6 and in the high-temperature coolant circuit 11, the electric pump 7 is activated, or its power is controlled, in accordance with a control command from the control device 15.

In this way, the example of FIG. 1 illustrates a previous example of a cooling arrangement comprising a main pump 23 for a high-temperature cooling line and a secondary pump (e.g., the electric pump 7) for the low-temperature cooling line. Such an arrangement presents certain issues. For example, arranging two pumps to address cooling needs increases a system complexity and packaging size. Furthermore, using two pumps is expensive and increases a manufacturing cost of the arrangement of the previous example. Additionally, two pumps may increase maintenance costs.

Turning now to FIG. 2, it schematically shows an arrangement according to the disclosure of an internal combustion engine with a charge-air cooler in an intake tract. FIG. 3 schematically shows a further variant of an arrangement according to the disclosure. The arrangement 1 according to the disclosure comprises a cooling radiator arrangement 50 according to the disclosure. In one example, the examples illustrated in both FIGS. 2 and 3 represent embodiments according to the present disclosure wherein a low-pressure pump is not included. In this way, the embodiments of FIGS. 2 and 3 at least partially solve the issues described above with regard to the previous example illustrated in FIG. 1.

The cooling radiator arrangement 50 according to the disclosure comprises an inlet 54, a high-temperature cooling radiator 12 arranged downstream of the inlet 54, a low-temperature cooling radiator 8 arranged downstream of the high-temperature cooling radiator 12, and an outlet 55 arranged downstream of the low-temperature cooling radiator 8. The high-temperature cooling radiator 12 furthermore comprises an outlet 52, and the low-temperature cooling radiator 8 comprises an inlet 53. The outlet 52 of the high-temperature cooling radiator 12 connected in terms of flow directly to the inlet 53 of the low-temperature cooling radiator 8 via a flow channel 51, wherein a control valve 57 according to the disclosure is arranged in the flow channel 51.

By contrast to the arrangement shown in the previous example of FIG. 1, a flow channel 65 also leads from an outlet 66 of the charge-air cooler 5 directly to the main pump 23. Furthermore, via a feed line 56, the control valve 57 is connected in terms of flow to the intake tract 3, whereby the valve 57 can be controlled via the charge pressure, as will be described in detail further below.

In the variant shown in FIG. 3, the low-temperature cooling radiator 8 is integrated in the form of a low-temperature cooling radiator element into the high-temperature cooling radiator 12. In this way, the example of FIG. 3 may illustrate the low-temperature cooling radiator 8 and the high-temperature cooling radiator 12 arranged in a common housing. In the variant shown in FIG. 2, both radiators are designed as individual, mutually independent components arranged in separate housings.

By contrast to the embodiment shown in FIG. 1, it is possible in the scope of the embodiment according to the disclosure shown in FIGS. 2 and 3 for the first temperature sensor 9, the electric pump 7 and the control thereof, and the feed lines 63 and 61 that are demanded in this context to be omitted. The embodiment is thus altogether less complex, requires less stowage space, and is easier to control. Additionally, the embodiments of FIGS. 2 and 3 are cheaper to manufacture than the embodiment of FIG. 1, thereby decreasing a cost to a consumer.

FIG. 4 schematically shows a control valve 57 according to the disclosure in a sectional view in a first working state. The control valve 57 according to the disclosure comprises a housing 71, an inlet 72, and an outlet 73, and a flow channel 74 for a first fluid medium. The control valve 57 furthermore comprises a closure 75 for at least partially opening and closing the flow channel 74.

The control valve 57 furthermore comprises an access 76 for at least one second fluid medium. The access 76 may for example be connected via the feed line 56 to the intake tract 3 of FIGS. 2 and 3.

The control valve 57 furthermore comprises a thermostat 77. The thermostat 77 is configured to detect the temperature of the first fluid medium. For this purpose, the thermostat 77 is connected in terms of flow to the flow channel 74 for the first fluid medium. The thermostat 77 is arranged between the closure 75 and the outlet 73.

The flow direction of the first fluid medium, for example of a cooling liquid from a high-temperature radiator 12 through the control valve 57, is denoted by the reference designation 80 and/or the arrow 80. The flow direction of the second fluid medium, for example of intake air, is denoted by the reference designation 81 and/or arrow 81. As such, air may enter the control valve 57 via the access 76 originally at an angle perpendicular to the flow of the first fluid medium, before turning and flowing in a direction parallel to the direction of the first fluid medium The control valve 57 comprises a first spring 78, which is arranged between the closure 75 and the thermostat 77. The control valve 57 furthermore comprises a second spring 79, which is arranged between the thermostat 77 and the outlet 73. The second spring 79 is arranged so as to hold the stop 84 for the first spring 78 in a starting position. The closure 75 can thus be moved counter to the pressure of the first spring 78 by the pressure of the second fluid medium (e.g., arrow 80). The thermostat 77 is configured to control an opening characteristic curve of the closure 75, wherein the second spring 79 can be pushed together or compressed and, here, the position of the stop 84, and thus the preload of the first spring 78, is modified in a manner dependent on the temperature of the first fluid medium. In the example of FIG. 4, the first spring 78 is upstream of the second spring 79 relative to a direction of medium flow through the control valve 57. Each of the first spring 78 and the second spring 79 may apply a pressure in a direction opposite the direction of arrow 80.

In order that the temperature of the first fluid medium can be detected via the thermostat 77, a leakage gap 82 is provided at the closure 75, such that a small fraction of the first fluid medium can flow past the closure 75 to the thermostat 77. As an alternative to the variant shown, a bypass flow channel may also be provided.

FIG. 4 shows the control valve 57 in a first working state, that is to say in a closed position. When in the closed position, the first fluid medium may not flow through the control valve 57 and to the low-temperature cooling radiator 8 of FIGS. 2 and 3. FIG. 5 shows the control valve 57 in a second working state, that is to say in a partially open position. The variant shown in FIGS. 4 and 5 relates, for example, to control valve positions in a condition of a low temperature of the first fluid medium and a particular charge pressure. In this variant, the first spring 78 has been compressed by the charge pressure or the pressure of the second fluid medium against the closure 75, and the closure 75 has thus been opened. The flow direction of the first fluid medium flowing past the closure 75 is denoted by the reference designation 83 (e.g., arrow 83). In this way, first fluid medium may fill the flow channel 74.

FIGS. 6 and 7 show a further variant, wherein FIG. 6 shows the control valve 57 in a sectional view in a first, that is to say closed, working state, and FIG. 7 shows the control valve 57 in a sectional view in a second, that is to say opened, working state. In the example of FIGS. 6 and 7, the second spring 79 has been compressed via the thermostat 77 owing to a high temperature of the first fluid medium. The preload of the first spring 78 has thus been reduced. That is to say, by compressing the second spring 79 via the thermostat, the force pressing against the first spring 78 is reduced. The control valve 57 can thus already be opened by the second fluid medium, that is to say moved into a second working state, in the presence of a lower charge pressure. This is schematically shown in FIG. 7.

In this way, the examples of FIGS. 4 and 5 illustrate a condition where a temperature of the first fluid medium is relatively low. More specifically, the temperature of the first fluid medium is less than a threshold temperature, and as such, the thermostat 77 does not actuate compress the second spring 79. During the examples of FIGS. 4 and 5, a pressure of the second fluid medium is used to actuate the closure 75 to admit the first working medium into the flow channel 74 and ultimately to the low-temperature cooling radiator.

The examples of FIGS. 6 and 7 illustrate adjusting a position of the control valve 57 in response to a first fluid medium temperature, as opposed to the second fluid medium pressure, as shown in FIGS. 4 and 5. As described above, a small amount of the first fluid medium may leak into the flow channel 74 via a gap between the closure 75 the housing 71. The small amount may be an amount sufficient for the thermostat to sense a temperature of the first fluid medium while still blocking the first fluid medium from flowing to the low-temperature cooling radiator. When the thermostat senses a temperature of the first fluid medium exceeding the threshold temperature, then the thermostat may compress the second spring 79 in a first direction parallel to arrow 80, such that a force applied to the first spring 78 and to the closure 75 is decreased. As such, a pressure of the first fluid medium may exceed a force of the first spring 78 acting against the closure 75 to allow the first fluid medium to enter the flow channel 74. In one example, the amount of the first fluid medium flowing to the flow channel 74 when the closure 75 is moved out of the closed position is higher than when the first fluid medium is leaking into the flow channel 74 and the closure 75 is in the closed position.

In one example, FIGS. 2-7 illustrate an engine system, comprising a first radiator arranged upstream of a second radiator relative to a direction of coolant flow, wherein the first radiator receives coolant from an engine and wherein the second radiator delivers coolant to a charge-air cooler and a control valve configured to adjust a coolant flow from the first radiator to the second radiator, wherein a position of the control valve is adjusted in response to an intake air pressure.

The control valve may receive intake air from a portion of an intake passage downstream of a compressor. The position may also be adjusted in response to one or more of a coolant pressure or a coolant temperature. A single pump is configured to conduct coolant flow through a single coolant circuit comprising each of the first radiator and the second radiator, wherein the single pump is a primary pump and the single coolant circuit does not comprise a second pump or any other device similar to the pump.

The control valve comprises a first spring pressing against a closure via a first spring force, further comprising a second spring pressing against a counter holder via a second spring force, wherein the second spring force is parallel to the first spring force. The closure seals a control valve inlet from a control valve outlet. A gap or a bypass is configured to route a sampling amount of coolant from the inlet to a thermostat. The sampling amount is an amount of coolant sufficient for the thermostat to determine a coolant temperature without being sufficient to flow to the low-temperature radiator. As such, the sampling amount may not reach the low-temperature radiator.

The thermostat presses against the second spring force and compresses the second spring and elongates the first spring in response to a temperature of the sampling amount of coolant being greater than a threshold temperature, and wherein the closure actuates away from the control valve inlet to fluidly coupled the control valve inlet to the control valve outlet. A combination of a coolant pressure and the intake air pressure adjust the position of the control valve to allow coolant to flow from a control valve inlet to a control valve outlet, wherein coolant exiting the control valve outlet flow to the second radiator.

Additionally or alternatively, a system comprises a single cooling circuit comprising only one coolant pump to conduct coolant from a high-temperature portion of the single cooling circuit to a low-temperature portion of the single cooling circuit, wherein the high-temperature portion comprises at least an engine and a high-temperature radiator, and wherein the low-temperature portion comprises at least a charge-air cooler and a low-temperature radiator and a control valve arranged in a passage fluidly coupling a high-temperature radiator outlet to a low-temperature radiator inlet, wherein the control valve is configured to receive coolant form the high-temperature radiator outlet and intake air from a portion of an intake passage downstream of a compressor, wherein the control valve comprises a closure blocking a control valve inlet from flowing coolant to a control valve outlet when in a closed position, wherein a first spring directly pushes the closure into the closed position, and wherein a second spring presses against the first spring via a counter holder, and wherein only the first spring compresses and actuates the closure away from the control valve inlet to fluidly couple the control valve inlet to the control valve outlet in response to one or more of a coolant pressure or intake air pressure exceeding a threshold pressure, and wherein the second spring compresses and actuates the counter holder away from the first spring in response to a coolant temperature, sensed by a thermostat, exceeding a threshold temperature. The coolant pressure is based on only the rotational speed of the only one coolant pump and wherein the intake air pressure is based on an engine load. The single coolant circuit does not comprise a second pump.

FIG. 8 graphically shows the valve position or the working state of the control valve 57 in a manner dependent on the pressure difference Δp of the first fluid medium prevailing between the inlet 72 and the outlet 73, and on the pressure from the line 81, in the form of a diagram. Here, the degree of opening x of the closure 75 is plotted on the x axis, wherein 0 denotes a closed state and 1 denotes a fully opened state. The pressure difference Δp across the valve is plotted schematically on the y axis.

The curve 91 denotes the opening behavior of the valve in the presence of a low temperature of the first fluid medium. The curve 92 denotes the opening behavior or the opening characteristic in the presence of a high temperature of the first fluid medium. The different opening behavior is attributed to the fact that the preload of the first spring 78 is regulated in a manner dependent on the temperature of the first fluid medium via the second spring 79 and of the thermostat 77, that is to say is lower in the presence of a higher temperature. In order to attain the valve position denoted by the reference designation 90, a higher pressure difference across the valve is desired in the presence of a lower temperature, see curve 91, and a smaller pressure difference is desired in the presence of a lower temperature, see curve 92.

In the variants shown, the coolant flow to the low-temperature coolant radiator 8 or to the low-temperature coolant radiator region is controlled by the control valve 57 via the charge pressure and/or the coolant pressure. A higher coolant flow is typically desired for higher loads and engine speeds. Furthermore, the characteristic of the valve is determined by the temperature of the coolant. Thus, the flow to the low-temperature cooling circuit is automatically adapted for different coolant temperatures.

The control valve 57 is opened by the charge pressure and/or the pressure of the coolant. The charge pressure is primarily a function of the load of the internal combustion engine, whereas the pressure of the coolant is a function of the rotational speed of the coolant pump. The additionally integrated thermostat 77 furthermore permits an adaptation of the characteristic of the control valve 57 in a manner dependent on the coolant temperature. In the presence of a relatively high coolant temperature, for example 60° C., the thermostat 77 displaces for example the counter holder 84 of the first spring 78, in particular via a compression of the second spring 79, whereby the preload of the first spring 78 is reduced. Particularly in the presence of high coolant temperatures, it is advantageous to allow a greater coolant flow to pass through the control valve 57, because more intense charge-air cooling is necessary.

FIG. 9 schematically shows a motor vehicle according to the disclosure. The motor vehicle 85 comprises an above-described arrangement 1 according to the disclosure of an internal combustion engine, such as the engine described below with respect to FIG. 10.

Turning now to FIG. 10, it shows a schematic depiction of a hybrid vehicle system 106 that can derive propulsion power from engine system 108 and/or an on-board energy storage device. An energy conversion device, such as a generator, may be operated to absorb energy from vehicle motion and/or engine operation, and then convert the absorbed energy to an energy form suitable for storage by the energy storage device. Engine 110 may be used similarly to the engine 2 of FIGS. 2 and 3.

Engine system 108 may include an engine 110 having a plurality of cylinders 130. Engine 110 includes an engine intake 124 and an engine exhaust 125. Engine intake 124 includes an air intake throttle 162 fluidly coupled to the engine intake manifold 144 via an intake passage 142. Air may enter intake passage 142 via air filter 152. Engine exhaust 125 includes an exhaust manifold 148 leading to an exhaust passage 135 that routes exhaust gas to the atmosphere. Engine exhaust 125 may include one or more emission control devices 170 mounted in a close-coupled position or in a far underbody position. The one or more emission control devices may include a three-way catalyst, lean NOx trap, selective catalytic reduction (SCR) device, particulate filter, oxidation catalyst, etc. It will be appreciated that other components may be included in the engine such as a variety of valves and sensors, as further elaborated in herein. In some embodiments, wherein engine system 108 is a boosted engine system, the engine system may further include a boosting device, such as a turbocharger comprising a turbine 180, a compressor 182, and a shaft 181 mechanically coupling the turbine 180 to the compressor 182.

Vehicle system 106 may further include control system 114. Control system 114 is shown receiving information from a plurality of sensors 116 (various examples of which are described herein) and sending control signals to a plurality of actuators 181 (various examples of which are described herein). As one example, sensors 116 may include exhaust gas sensor 126 located upstream of the emission control device, temperature sensor 128, and pressure sensor 129. Other sensors such as additional pressure, temperature, air/fuel ratio, and composition sensors may be coupled to various locations in the vehicle system 106. As another example, the actuators may include the throttle 162.

Controller 115 may be configured as a conventional microcomputer including a microprocessor unit, input/output ports, read-only memory, random access memory, keep alive memory, a controller area network (CAN) bus, etc. Controller 115 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, hybrid vehicle 106 comprises multiple sources of torque available to one or more vehicle wheels 159. In other examples, vehicle 106 is a conventional vehicle with only an engine, or an electric vehicle with only electric machine(s). In the example shown, vehicle 106 includes engine 110 and an electric machine 151. Electric machine 151 may be a motor or a motor/generator. A crankshaft of engine 110 and electric machine 151 may be connected via a transmission 154 to vehicle wheels 159 when one or more clutches 156 are engaged. In the depicted example, a first clutch 156 is provided between a crankshaft and the electric machine 151, and a second clutch 156 is provided between electric machine 151 and transmission 154. Controller 115 may send a signal to an actuator of each clutch 156 to engage or disengage the clutch, so as to connect or disconnect crankshaft from electric machine 151 and the components connected thereto, and/or connect or disconnect electric machine 151 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 151 receives electrical power from a traction battery 161 to provide torque to vehicle wheels 159. Electric machine 151 may also be operated as a generator to provide electrical power to charge battery 161, for example during a braking operation.

Turning now to FIG. 11, it shows a method 1100 for adjusting a position of a control valve, such as control valve 57 of FIGS. 2-7. The method 1100 begins at 1102, which includes determining, estimating, and/or measuring current engine operating parameters. Current engine operating parameters may include but are not limited to one or more of throttle position, manifold vacuum, engine load, engine temperature, boost, and air/fuel ratio.

The method 1100 proceeds to 1104, which includes determining if a fluid medium pressure is greater than a threshold pressure. In one example, the threshold pressure is based on a spring force of a first spring, wherein the first spring presses the closure to a closed position, thereby blocking the fluid medium from flowing into the flow channel. The fluid medium pressure may correspond to a second fluid medium pressure, wherein the second fluid medium is charge air from a compressor, such as compressor 4 of FIGS. 2 and 3 and/or compressor 182 of FIG. 10. Additionally or alternatively, the fluid medium pressure may be based on a pressure of the first fluid medium, wherein the first fluid medium is coolant. In one example, the charge air pressure may correspond to an engine load and the coolant pressure may correspond to a coolant pump rotational speed. In one example, pressures applied by the charge air and the coolant may be combined and compared against the threshold pressure.

If the fluid medium pressure is greater than the threshold pressure, then the method 1100 proceeds to 1106, which includes only actuating the closure and compressing only the first spring. As such, the second spring may not be compressed in response to a pressure of the fluid medium exceeding the threshold pressure. The method 1100 proceeds to 1108, which includes flowing the first fluid medium to the flow channel and out the control valve to the low-temperature cooling radiator. In this way, only the first fluid medium flows to the low-temperature cooling radiator, while the second fluid medium does not flow to the low-temperature cooling radiator.

Returning to 1104, if the fluid medium pressure is not greater than the threshold pressure, then the method 1100 proceeds to 1110, which includes determining if a fluid medium temperature is greater than a threshold temperature. In one example, the fluid medium temperature is a temperature of only the first fluid medium. As described above, a gap and/or bypass may be arranged to directing a small amount (e.g., a sampling amount) of the first fluid medium from the inlet of the control valve to the thermostat (e.g., inlet 72 and thermostat 77, respectively, of FIGS. 4-7). If the first fluid medium temperature is greater than the threshold temperature, then cooling may be desired and the method 1100 proceeds to 1112, which includes actuating the counter holder against the second spring. By doing this, the first spring may expand as less force is applied thereto, while the closure 75 may remain in a closed position. Additionally, the second spring may be compressed as the counter holder overcomes a force of the second spring and presses against it.

The method 1100 proceeds to 1114, which includes actuating the closure and compressing the first spring. As such, the first fluid medium may enter the flow channel. The closure may move in response to a pressure of one or more of the first fluid medium and the second fluid medium.

The method 1100 proceeds to 1116, which includes flowing the first fluid medium to the low-temperature cooling radiator. As such, the hot first fluid medium may be cooled, promoting a desired cooling effect of components arranged along the low-temperature cooling circuit.

Returning to 1110, if the fluid medium temperature is not greater than the threshold temperature, then the method 1100 proceeds to 1118, which includes maintaining the position of the first and second springs. As such, the counter holder may not be moved and the closure may not be moved such that the first spring is fully compressed and fluid flow into the flow channel is blocked.

The method 1100 proceeds to 1120, which includes blocking flow of the first fluid medium to the low-temperature cooling radiator. The closure remains in the closed position, thereby blocking first fluid medium flow into the flow channel, which blocks flow to the low-temperature cooling radiator.

In one example, an engine system, comprises a first radiator arranged upstream of a second radiator relative to a direction of coolant flow. The first radiator receives coolant from an engine and the second radiator delivers coolant to a charge-air cooler. A control valve may be configured to adjust a coolant flow from the first radiator to the second radiator, wherein a position of the control valve is adjusted in response to an intake air pressure. The control valve may receive intake air from a portion of an intake passage downstream of a compressor.

The position of the control valve may be further adjusted in response to one or more of a coolant pressure and a coolant temperature. The control valve comprises a first spring pressing against a closure via a first spring force, further comprising a second spring pressing against a counter holder via a second spring force, wherein the second spring force is parallel to the first spring force. The closure seals a control valve inlet from a control valve outlet. A gap or a bypass configured to route a sampling amount of coolant from the inlet of the control valve to a thermostat. The thermostat presses against the second spring force and compresses the second spring and elongates the first spring in response to a temperature of the sampling amount of coolant being greater than a threshold temperature, and wherein the closure actuates away from the control valve inlet to fluidly coupled the control valve inlet to the control valve outlet. A combination of a coolant pressure and the intake air pressure adjust the position of the control valve to allow coolant to flow from a control valve inlet to a control valve outlet, wherein coolant exiting the control valve outlet flow to the second radiator. The first radiator is a high-temperature radiator and the second radiator is a low-temperature radiator. A single pump is configured to conduct coolant flow through a single coolant circuit comprising each of the first radiator and the second radiator.

In one example, additionally or alternatively, a system, comprises a single cooling circuit comprising only one coolant pump to conduct coolant from a high-temperature portion of the single cooling circuit to a low-temperature portion of the single cooling circuit, wherein the high-temperature portion comprises at least an engine and a high-temperature radiator, and wherein the low-temperature portion comprises at least a charge-air cooler and a low-temperature radiator and a control valve arranged in a passage fluidly coupling a high-temperature radiator outlet to a low-temperature radiator inlet, wherein the control valve is configured to receive coolant form the high-temperature radiator outlet and intake air from a portion of an intake passage downstream of a compressor, wherein the control valve comprises a closure blocking a control valve inlet from flowing coolant to a control valve outlet when in a closed position, wherein a first spring directly pushes the closure into the closed position, and wherein a second spring presses against the first spring via a counter holder, and wherein only the first spring compresses and actuates the closure away from the control valve inlet to fluidly couple the control valve inlet to the control valve outlet in response to one or more of a coolant pressure or intake air pressure exceeding a threshold pressure, and wherein the second spring compresses and actuates the counter holder away from the first spring in response to a coolant temperature, sensed by a thermostat, exceeding a threshold temperature. The coolant pressure is based on only the rotational speed of the only one coolant pump and wherein the intake air pressure is based on an engine load. The single coolant circuit does not comprise a second pump.

FIGS. 1-7, and 10 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

In this way, a packaging size of a cooling arrangement may be reduced by configuring a single pump to conduct coolant to high and low temperature portions of a cooling circuit. The circuit may further comprise a control valve configured to actuate in response to coolant and intake air pressure and/or to coolant temperatures. The technical effect of using a single pump in combination with the control valve is to decrease a packaging size and manufacturing cost, while providing a desired cooling based on engine loads and coolant temperatures.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a control valve for controlling a flow of a first fluid medium from a high-temperature coolant circuit to a low-temperature coolant circuit, wherein the control valve comprises a housing, a flow channel, an inlet for receiving the first fluid medium and an outlet for expelling the first fluid medium, a closure configured to open or close the flow channel, an access for at least one second fluid medium to flow and contact the closure, and a thermostat fluidly coupled to the flow channel, wherein the thermostat is arranged between the closure and the outlet, wherein the control valve comprises a first spring arranged between the closure and the thermostat and a second spring arranged between the thermostat and the outlet, wherein a pressure of the second spring is transferred to the first spring, wherein the closure is moved to counter the pressure of the second spring via a pressure of the at least one second fluid medium, and the thermostat is configured to control an opening characteristic curve of the closure such that the closure closes the flow channel in a first working state and at least partially opens said flow channel in a second working state.

2. The system of claim 1, wherein the first fluid medium is a coolant of the high-temperature coolant circuit for a charge-air cooler for an internal combustion engine of a vehicle.

3. The system of claim 1, wherein the access for the at least one second fluid medium has a fluid connection to an intake tract of an internal combustion engine.

4. The system of claim 1, wherein the control valve is configured to detect a temperature of the first fluid medium via the thermostat.

5. The system of claim 1, wherein the closure is configured such that, in the first working state, the inlet is fluidly coupled to the thermostat via a bleed line, such that a portion of the first fluid medium flows to the thermostat and not through the outlet.

6. The system of claim 1, further comprising a cooling radiator arrangement comprising a high-temperature cooling radiator arranged along the high-temperature coolant circuit and a low-temperature cooling radiator arranged along the low-temperature coolant circuit, wherein the control valve is arranged between the high-temperature cooling radiator and the low-temperature cooling radiator, and wherein the control valve is configured to adjust coolant flow from the high-temperature cooling radiator to the low-temperature cooling radiator.

7. The system of claim 6, wherein the low-temperature cooling radiator is integrated into the high-temperature cooling radiator.

8. An engine system, comprising:

a first radiator arranged upstream of a second radiator relative to a direction of a coolant flow, wherein the first radiator receives coolant from an engine and wherein the second radiator delivers coolant to a charge-air cooler; and a control valve configured to adjust the coolant flow from the first radiator to the second radiator, wherein a position of the control valve is adjusted in response to one or more of an intake air pressure and a coolant pressure via a first spring pressing against a closure of the control valve, and wherein the position of the control valve is further adjusted in response to a coolant temperature sensed by a thermostat via a second spring pressing against the first spring via a counter holder of the control valve.

9. The engine system of claim 8, wherein the control valve receives intake air from a portion of an intake passage downstream of a compressor.

10. The engine system of claim 8, wherein a single pump is configured to conduct the coolant flow through a single coolant circuit comprising each of the first radiator and the second radiator.

11. The engine system of claim 8, wherein the control valve comprises the first spring pressing against the closure via a first spring force, and the second spring pressing against the counter holder via a second spring force, wherein the second spring force is parallel to the first spring force.

12. The engine system of claim 11, wherein the closure seals a control valve inlet from a control valve outlet.

13. The engine system of claim 12, further comprising a bypass configured to route a sampling amount of coolant from the control valve inlet to the thermostat.

14. The engine system of claim 13, wherein the thermostat presses against the second spring force and compresses the second spring and elongates the first spring in response to a temperature of the sampling amount of coolant being greater than a threshold temperature, and wherein the closure actuates away from the control valve inlet to fluidly couple the control valve inlet to the control valve outlet.

15. The engine system of claim 8, wherein a combination of the coolant pressure and the intake air pressure adjust the position of the control valve to allow coolant to flow from a control valve inlet to a control valve outlet, and wherein coolant exiting the control valve outlet flows to the second radiator.

16. The engine system of claim 8, wherein the first radiator is a high-temperature radiator and the second radiator is a low-temperature radiator.

17. A system, comprising:

a single cooling circuit comprising only one coolant pump to conduct coolant from a high-temperature portion of the single cooling circuit to a low-temperature portion of the single cooling circuit, wherein the high-temperature portion comprises at least an engine and a high-temperature radiator, and wherein the low-temperature portion comprises at least a charge-air cooler and a low-temperature radiator; and a control valve arranged in a passage fluidly coupling a high-temperature radiator outlet to a low-temperature radiator inlet, wherein the control valve is configured to receive coolant from the high-temperature radiator outlet and intake air from a portion of an intake passage downstream of a compressor, wherein the control valve comprises a closure blocking a control valve inlet from flowing coolant to a control valve outlet when in a closed position, wherein a first spring directly pushes the closure into the closed position, wherein a second spring presses against the first spring via a counter holder, wherein only the first spring compresses and actuates the closure away from the control valve inlet to fluidly couple the control valve inlet to the control valve outlet in response to one or more of a coolant pressure and an intake air pressure exceeding a threshold pressure, and wherein the second spring compresses and actuates the counter holder away from the first spring in response to a coolant temperature, sensed by a thermostat, exceeding a threshold temperature.

18. The system of claim 17, wherein the coolant pressure is based on only the rotational speed of the only one coolant pump and wherein the intake air pressure is based on an engine load.

19. The system of claim 17, wherein the single cooling circuit does not comprise a second coolant pump.

* * * * *